US005211221A

United States Patent [19]

Lease

[11] Patent Number: 5,211,221

[45] Date of Patent: May 18, 1993

[54] METHOD AND APPARATUS FOR JOINING COOLANT TUBES OF A HEAT EXCHANGER

[75] Inventor: Thomas M. Lease, Canton, S. Dak.

[73] Assignee: McCord Heat Transfer, Walled Lake, Mich.

[21] Appl. No.: 906,565

[22] Filed: Jun. 30, 1992

Related U.S. Application Data

[63] Continuation-in-part of Ser. No. 798,550, Nov. 26, 1991, abandoned.

[51] Int. Cl.[5] ..... F28D 1/04; B21D 39/04; F16L 25/00

[52] U.S. Cl. ..... 165/150; 165/79; 29/890.036; 156/294; 228/173.4; 285/915

[58] Field of Search ..... 165/79, 150, 178; 156/293, 294; 285/915, 157, 124; 29/890.036; 228/154, 173.4, 183

[56] References Cited

U.S. PATENT DOCUMENTS

| | | | |
|---|---|---|---|
| 1,926,460 | 9/1933 | Slagel | 165/79 |
| 1,931,467 | 10/1933 | Young | 165/149 |
| 2,322,587 | 6/1943 | Payne | 285/115 |
| 2,368,610 | 1/1945 | Fischer | 18/59 |
| 2,498,831 | 2/1950 | Veitch | 285/161 |
| 3,124,874 | 3/1964 | Woolley | 29/458 |
| 3,347,728 | 10/1967 | Preotle et al. | 156/283 |
| 3,476,408 | 11/1969 | Wolfe | 285/21 |
| 3,498,866 | 3/1970 | Kilbane | 156/285 |
| 3,633,266 | 1/1972 | Taylor | 228/183 |
| 3,633,660 | 1/1972 | Young | 165/69 |
| 3,636,186 | 1/1972 | Sturley | 264/135 |
| 3,709,757 | 1/1973 | Sturley | 156/423 |
| 3,750,248 | 8/1973 | Morris | 29/157.3 R |
| 3,796,783 | 3/1974 | Greever | 264/135 |
| 3,817,210 | 6/1974 | Greever | 118/408 |
| 3,877,518 | 4/1975 | Dreksler | 165/150 |
| 3,909,045 | 9/1975 | Meagher | 285/22 |
| 3,937,641 | 2/1976 | Kushner et al. | 156/87 |
| 3,993,126 | 11/1976 | Taylor | 165/173 |
| 4,022,500 | 5/1977 | van den Beld | 285/915 |
| 4,076,167 | 2/1978 | Wright | 228/173 |
| 4,095,825 | 6/1978 | Butler | 156/194 |
| 4,186,474 | 2/1980 | Hine | 29/157.3 A |
| 4,196,923 | 4/1980 | Zimmerli | 285/284 |
| 4,295,522 | 10/1981 | Frei | 165/79 |
| 4,305,459 | 12/1981 | Nonnenmann | 165/173 |
| 4,484,621 | 11/1984 | Kuchelmeister | 165/67 |
| 4,502,532 | 3/1985 | Tomozaki et al. | 165/79 |
| 4,505,017 | 3/1985 | Schukei | 29/157.3 R |
| 4,546,822 | 10/1985 | Tamura | 165/149 |
| 4,696,499 | 9/1987 | Butler | 285/234.4 |
| 4,858,686 | 8/1989 | Calleson | 165/173 |

*Primary Examiner*—John Rivell
*Assistant Examiner*—L. R. Leo
*Attorney, Agent, or Firm*—Reising, Ethington, Barnard, Perry & Milton

[57] ABSTRACT

A joint (24) and method of making the same for interconnecting various segments of coolant tubes of heat exchangers. The instant joint (24) includes a first tube (26) having a necked end (38) with a reduced outer diameter (40) and a second tube (30) having a frustro-conical portion (34) with a steadily increasing inner diameter. The necked end (38) of the first tube (26) is inserted within the frustro-conical portion (34) of the second tube (30) thus forming a frustro-conical portion shaped increasing gap space therebetween. The increasing gap space is filled with epoxy adhesive to form a bond (44) of steadily increasing thickness between the outer diameter (28) of the first tube (26) and the steadily increasing inner diameter of the frustro-conical portion (34) of the second tube (30).

12 Claims, 1 Drawing Sheet

METHOD AND APPARATUS FOR JOINING COOLANT TUBES OF A HEAT EXCHANGER

BACKGROUND OF THE INVENTION

This is a continuation-in-part application of U.S. patent application Ser. No. 07/798,550 filed Nov. 26, 1991, now abandoned.

1. Technical Field

The subject invention relates to a joint for joining coolant tubes of heat exchangers.

2. Description of the Related Art

Heat exchangers having "serpentine" configurations are often used because of their extensive coolant tube length and compact size. The "serpentine" configuration refers to the general path of the coolant tubes which pass through the heat exchanger. An example of such a "serpentine" heat exchanger is shown in U.S. Pat. No. 3,498,866 to Kilbane.

The coolant tubes of such heat exchanger are typically arranged parallel to one another and extend through a plurality of fins. The fins are usually arranged perpendicular to the coolant tubes. The adjacent ends of the coolant tubes are interconnected by way of a U-shaped junction or tube, thus forming a continuous serpentine path in which fluid may pass therethrough. The U-shaped tubes and the ends of the coolant tubes are interconnected by forming a joint therebetween. Typically, such a joint is formed by tapering the end of one tube (forming a bell end) and necking the end of the other tube (forming a spigot end) and subsequently inserting the necked end within the frustro-conical portion forming a male/female relationship. Examples of joints formed by necking and tapering operations are shown in U.S. Pat. Nos. 2,498,831 to Veitch and 3,877,518 to Dreksler.

Bonding material is disposed at the interface between the tapered and necked ends of the coolant tubes in order to form a fluid-tight seal therebetween capable of withstanding ample pressure. Typical bonding materials include zinc solder and copper or phospho-copper brazing as shown in U.S. Pat. No. 1,931,467 to Young.

Although the aforementioned bonding materials are quite popular, they suffer from several major drawbacks. For example, the brazing techniques employed with such bonding materials often result in leaks and must be further treated. Because of the highly critical nature of the bond between the joined tubes, brazing techniques suffer from low production rates. Low production rates are further attributed to subsequent rinsing of brazing flux which is often necessary with such techniques.

Epoxy adhesives have been substituted for prior bonding materials in an effort to overcome the deficiencies previously discussed. By way of example, U.S. Pat. No. 3,937,641 to Kushner et al., U.S. Pat. No. 3,498,866 to Kilbane, and U.S. Pat. No. 3,877,518 to Dreksler all disclose the use of epoxy adhesive to join interfitted segments of coolant tubes.

Although epoxy adhesives enjoy many advantages over prior bond materials, epoxy adhesives present unique problems. For example, the tapering and necking operations utilized to create the overlapping male/female tube ends, although intended to be highly accurate, often result in tube ends which have varying dimensions. Due to each tube's unique characteristics, the resulting diameters of the tapered and neck ends vary from tube to tube. Accordingly, the gap space created between the neck and tapered tube ends varies from tube to tube. Although this gap space is relatively insignificant when using prior brazing materials, it can have a drastic effect upon the strength of an epoxy bond. For example, a typical braze joint includes a gap space of 0.003 to 0.005 inches. When using such a gap space with epoxy resins the bonds tend to fail due to trapped air in the gap space and due to the required epoxy bond thickness necessary for proper chemical linking. The bond and sealing strength of epoxy adhesives is critically dependent upon the thickness of the bond. Thus, in order to insure proper bonding thickness, the gap space between the necked and tapered tube ends becomes critical. One method of assuring the proper bond thickness is to provide a gap space having a varying thickness including an optimum range thickness, thus assuring the optimum bond thickness.

Unfortunately, epoxy adhesives and most other polymeric resin materials tend to be quite viscous, thus making them difficult to dispense. For example, after an end of a first tube has been inserted into the end of a second tube to form a joint, it is difficult to pour, spread or otherwise dispose adhesive material in the gap space between the overlapping ends of the first and second tubes. Moreover, air pockets are formed between the overlapping ends of the tubes. That is, after the first tube is inserted within the second tube and polymeric adhesive is subsequently disposed into the gap space created between the first and second tubes, air becomes trapped within the joint. When the joint is later heated to cure the adhesive, the air trapped within the joint expands thereby weakening or breaking the resulting bond between the first and second tubes.

One method of avoiding this problem is to pre-place the adhesive on the ends of the tubes prior to joining them. For example, U.S. Pat. No. 3,937,641 to Kushner et. al. discloses a joint wherein epoxy tape is wrapped about the end of a first tube prior to inserting the first tube within the second tube. Subsequently, the ends of the tubes are heated and the tape is melted to a liquid which occupies the area between the first and second tubes. Unfortunately, such pre-place adhesive techniques are very labor intensive and require the time consuming step of pre-placing adhesive about an end of a tube.

SUMMARY OF THE INVENTION AND ADVANTAGES

The present invention is directed toward a joint for joining coolant tubes of heat exchangers. The joint comprises: a first tube having an outer diameter and a second tube having an inner diameter, a frustro-conical portion, and a distal end. The frustro-conical portion tapers steadily outward from the inner diameter of the second tube to the distal end and forms a steadily increasing inner diameter. A first portion of the first tube is disposed within the second tube and forms a surface contact between the outer diameter of the first tube and the steadily increasing inner diameter of the frustro-conical portion. A second portion of the first tube extends out from the second tube. A steadily increasing gap space is formed between the outer diameter of the first tube and the steadily increasing inner diameter of the frustro-conical portion of the second tube. The gap space extends directly from the surface contact and steadily increasing in thickness to a position adjacent the distal end thereby forming a frustro-conical portion access from the distal end directly to the surface contact. Liquid polymeric material is disposed into the increasing gap space to form a bond of steadily increasing thickness between the outer diameter of the first tube and the steadily increasing inner diameter of the frustro-conical portion of the second tube. The bond extends from the surface contact between the increasing inner diameter of the frustro-conical portion of the second tube and the outer diameter of the first tube and steadily increasing in thickness to a position adjacent the distal end.

The present invention further includes a method for making the subject joint. The method comprises the steps of: tapering a portion of the second tube to form a frustro-conical portion having a steadily increasing inner diameter extending directly from said inner diameter to a distal end; inserting a portion of the first tube within the second tube and forming a surface contact therebetween thereby creating a steadily increasing gap space extending directly from the surface contact between the outer diameter of the first tube and the steadily increasing inner diameter of the frustro-conical portion of the second tube to a position adjacent said distal end; and disposing organic polymeric material within the increasing gap space to form a bond of steadily increasing thickness extending directly from the surface contact between the first and second tubes to a position adjacent the distal end.

An advantage of instant method and the resulting joint is realized by providing a bond of optimum thickness between the first and second tubes to guarantee maximum joint strength.

An advantage of using a frustro-conical portion which extends from the inner diameter of the second tube to a distal end is that air is allowed to escape from the gap space between the first and second tubes while polymeric material is disposed therein. Thus, the resulting bond is void free and remains intact after the polymeric material is cured.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
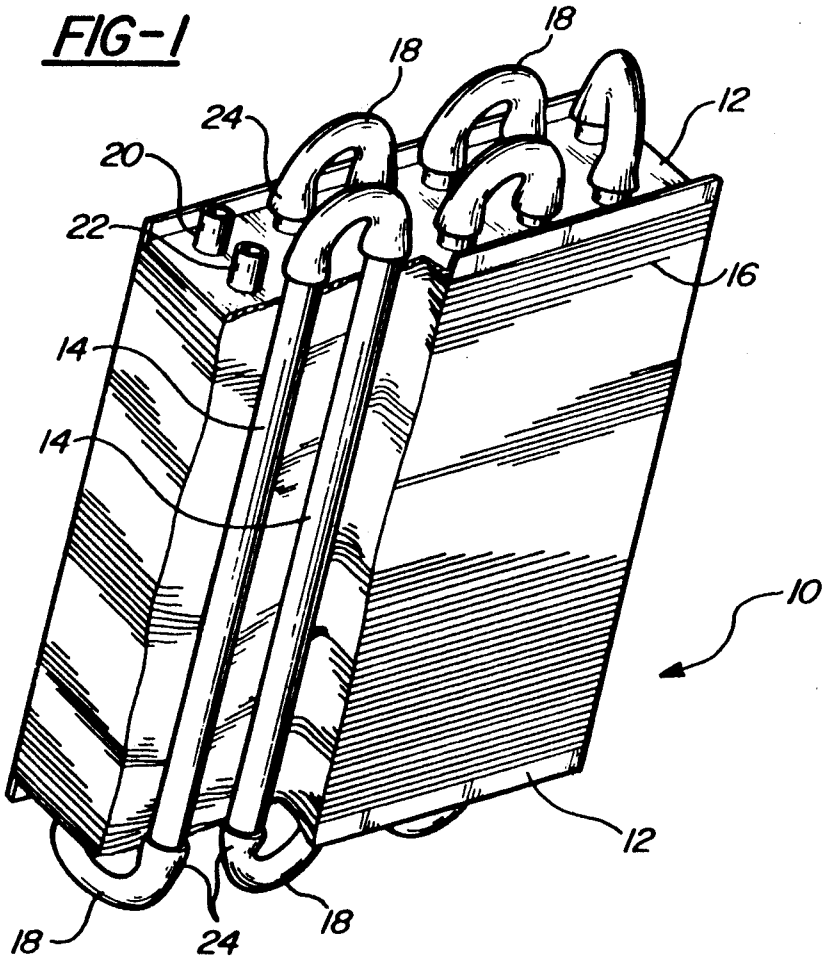
FIG. 1 is a perspective view of a heat exchanger partially cut away showing the coolant tubes.

Referring now to the drawings wherein like numerals indicate corresponding parts throughout the several views, a heat exchanger is generally shown at 10 in FIG. 1. The heat exchanger 10 is shown having a generally rectangular shape and including end caps or headers 12 at opposite ends. A plurality of coolant tubes 14 are arranged parallel to one another and extend longitudinally between the headers 12 and project outward therefrom. The coolant tubes 14 are preferable made from materials having high thermal conductivities so as to enhance heat flow therethrough. Materials such as aluminum, copper, brass and steel are commonly used materials.

The heat exchanger 10 may include fins 16, as shown in FIG. 1, particularly when air is used to draw heat from system; more specifically, as air passes through the heat exchanger 10, the fins 16 direct airflow about the coolant tubes 14 to optimize the heat exchange between the passing air in the coolant tubes 14. As shown in FIG. 1, the fins 16 are preferable arranged perpendicularly to the coolant tubes 14. Alternately, the fins 16 may be omitted from the system entirely, particularly when liquid is used as the coolant medium, instead of air.

U-shaped unions or tubes 18 are used to interconnect the parallely arranged coolant tubes 14 in order to form a serpentine path throughout the heat exchanger 10. Such a serpentine path maximizes tube length while allowing the heat exchanger 10 to remain relatively compact. The heat exchanger 10 includes an intake 20 for allowing heated fluids to enter the heat exchanger 10 and travel through the serpentine path of the coolant tubes 14. An outtake 22 provides an exit for the fluid to depart from the heat exchanger 10.

Figure 2:
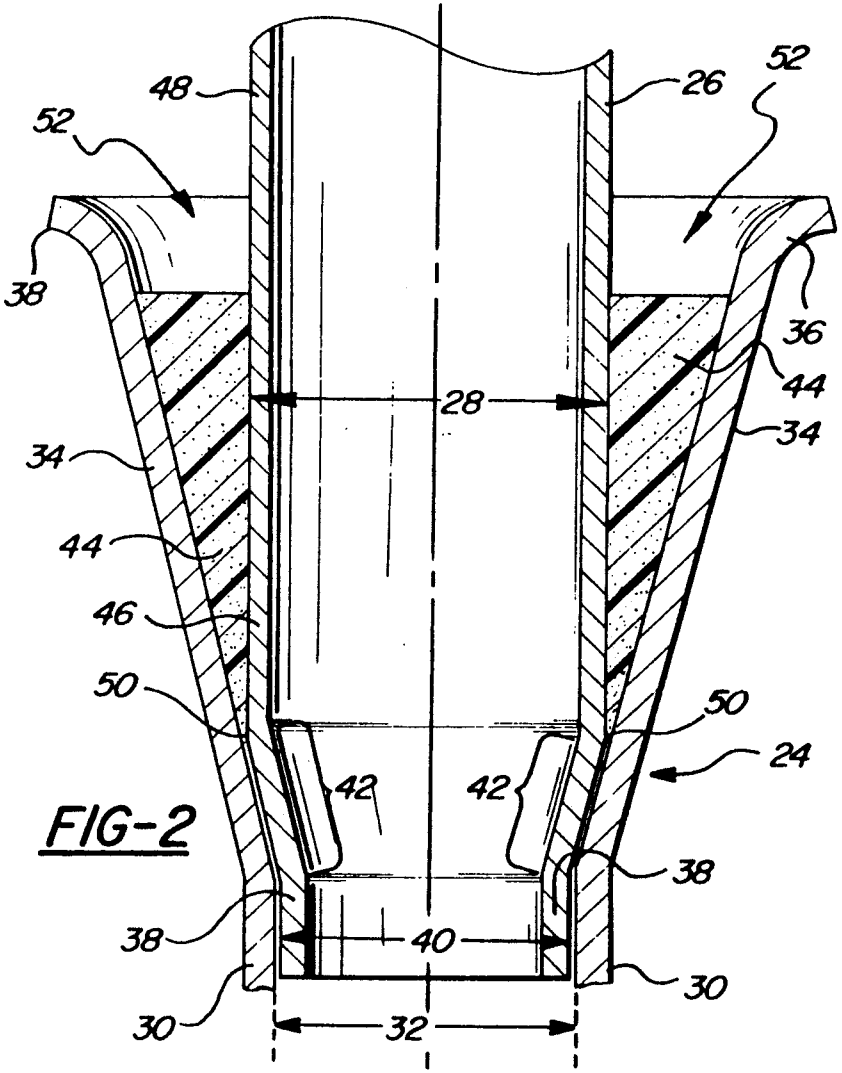
FIG. 2 is an enlarged cross-sectional side view of the preferred embodiment of the subject joint between the first and second tubes.

The U-shaped tubes 18 and the ends of the coolant tubes 14 are interconnected by forming a joint therebetween. The subject joint is shown at 24 in the drawings and is best shown in FIG. 2. Turning to FIG. 2, a joint 24 is shown comprising a first tube 26 having an outer diameter 28 and a second tube 30 having an inner diameter 32. Preferably the first 26 and second 30 tubes are roughly the same dimension i.e., having the same inner and outer diameters. The second tube 30 includes a frustro-conical portion 34 which tapers steadily outwardly from the inner diameter 32 to a distal end 36 and forms a steadily increasing inner diameter. The distal end 36 is located at the far extreme of the frustro-conical portion 34 and preferably includes a flared extremity 38 which flares outwardly therefrom.

The first tube 26 includes a necked end 38 having a reduced outer diameter 40. This reduced outer diameter 40 is substantially similar to the inner diameter 32 of the second tube 30 so that the necked end 38 may be tightly interfit within the second tube 30.

A transition region 42 having a steadily decreasing outer diameter interconnects the outer diameter 28) and the necked end 38. Unlike the relatively uniform outer diameter 28 of the first tube 26 and the necked end 38, the transition region 42 provides a steadily decreasing outer diameter.

To form the subject joint 24, a first portion 46 of the first tube 26 is inserted within the frustro-conical portion 34 of the second tube 30 with a second portion 48 extending out of the second tube 30. More specifically, the necked end 38 of the first tube 26 is inserted into the frustro-conical portion 34 of the second tube 30 until the reduced outer diameter 40 of the necked end 38 is tightly interfit within the inner diameter 32 of the second tube 30 and the transition region 42 of the first tube 26 abuts the steadily increasing inner diameter of the frustro-conical portion 34 of the second tube 30 thus forming a surface contact 50 therebetween.

With the first tube 26 inserted within the second tube 30, an increasing gap space is formed between the outer diameter 28 of the first tube 26 and the steadily increasing inner diameter of the frustro-conical portion 34 of the second tube 30. The gap space preferably extends directly from the surface contact 50 and steadily increases in thickness to a position adjacent the distal end 36 thereby forming a frustro-conical portion access 52 from the distal end directly to the surface contact 50.

Organic polymeric material is disposed within the increasing gap space to form a bond 44 of steadily increasing thickness between the outer diameter 28 of the first tube 26 and the steadily increasing inner diameter of the frustro-conical portion 34 of the second tube 30. The particular manner in which the organic polymeric material is disposed within the gap space is dependent upon the specific material being used. For example, liquid materials may be poured or sprayed, however, because of the viscous nature of most materials, spraying may not be practical. Other materials are presented in paste form and are disposed within the gap space by use of a putty knife, spatula, or other similar applicator.

The bond 44 extends from the surface contact 50 between the increasing inner diameter of the frustro-conical portion 34 of the second tube 30 and the outer diameter 28 of the first tube 26, and the bond 44 steadily increases in thickness to a position adjacent the distal end 36.

It is a result of the shape of the frustro-conical portion 34 extending directly from the distal end 36 to the surface contact 50 that allows air to escape from the gap space as the organic polymeric material is poured, spread, or otherwise disposed therein. That is, the frustro-conical portion access 52 permits viscous liquid material to be poured or paste like material to be spread from the distal end 36, all the way to the contact surface 50 while simultaneously allowing air to escape from the gap space.

To further avoid trapping air within the gap space, the organic polymeric material may be heated to lower the viscosity thereof, however, care should be taken not to elevate the temperature of the material to the point where curing may take place. Furthermore, the ends of the tubes 26,30 may also be heated to promote better material flow.

The bond strength of the organic polymeric material is generally dependent upon the bond thickness and is usually optimized by a range of thickness rather than a particular thickness. Thus, the subject joint 24 provides a bond 44 having a thickness which is designed to encompass the optimum range of thickness for a particular adhesive material being used. For example, a typical braze joint includes a gap space of 0.003 to 0.005 inches. When using such a joint with epoxy resins, the resulting joint tends to fail due to trapped air being forced from the gap space during curing. Additionally, such a gap space dimension is too small for epoxy resins to provide the ideal chemical molecule linking. When using the preferred material, B. F. Goodrich's epoxy resin (A-1223-B), it has been found that the optimum range of bond thickness is 0.065 to 0.015 inches. Thus, the dimension of the increasing gap space is designed to encompass this range and not excessively surpass the upper end of the range i.e., 0.015 inches thereby conserving bonding material. Bonds having a thickness covering the range of 0.065 to 0.015 inches have been found to perform well at operating pressures between 150 to 300 p.s.i. and have held up under test pressures of 700 and 1500 p.s.i.

Although epoxy adhesive is preferred to other organic polymeric materials due to its relatively low cost and desirable physical properties, it is to be understood that any other suitable organic polymeric material may be substituted.

It is important to note that the interfit between the necked end 38 of the first tube 26 and the inner diameter 32 of the second tube 30 serves an important purpose. Namely, the interfit serves to properly align the first tube 26 relative to the second tube 30. That is, if the necked end 38 did not tightly interfit within the inner diameter 32 of the second tube 30, the first tube 26 would be free to tilt laterally due to the steadily increasing inner diameter of the frustro-conical portion 34 of the second tube 30. Thus, the tight interfit between the necked end 38 and the inner diameter 32 of the second tube 30 serves to support the first tube 26 within the second tube 30 and prevent lateral movement therebetween.

It is also important to note the significance of inserting the first tube 26 within the second tube 30 until the transition region 42 of the first tube 26 abuts the steadily increasing inner diameter of the frustro-conical portion 34 of the second tube 30. The importance of this surface contact 50 is noted for two primary reasons. Firstly, this surface contact 50 provides a "stop" so that the first tube 26 is inserted the proper distance within the second tube 30. Thus, the insertion depth of the first tube 26 remains consistent among various first and second tubes. Secondly, the surface contact 50 provided between the transition region 42 and the frustro-conical portion 34 is over an area rather than a specific point. That is, the steadily increasing outer diameter of the transition region 42 roughly corresponds in dimension to a portion of the steadily increasing inner diameter of the frustro-conical portion 34. Thus, when the transition region 42 abuts the frustro-conical portion 34, contact is made therebetween over a surface area rather than simply abutting at a point. This surface contact 50 area is important in providing a fluid seal between the first and second tubes for preventing bonding material from flowing therethrough. That is, when bonding material is disposed in the steadily increasing gap space, it is important to prevent the bonding material from passing through the joint 24 and entering into the second tube 30. Most organic polymeric bonding materials have poor thermal conductivity properties. Thus, if the bonding material is permitted to flow into the tubes, the overall heat exchange properties of the tubes are reduced. The aforementioned surface contact 50 provides a seal over a larger area, thus preventing bonding material from flowing therethrough.

Preferably, the U-shaped tube 18 corresponds to the first tube 26 of the subsequent discussion and the coolant tube 24 corresponds to the second tube 30. That is, the end of the U-shaped tube 18 is necked and the end of the coolant tube 14 is tapered and flared. However, it should be understood that the U-shaped tube 14 may, in fact, correspond to the second tube 30 of the subsequent discussion. The coolant tube 14 may correspond to the first tube 26. Such an alternate embodiment is shown in FIG. 1.

The preferred method of making the subject joint 24 will now be discussed in detail. The subject method comprises a number of steps including common necking, flaring, and tapering techniques discussed below.

A portion of the second tube 30 is tapered to expand the inner diameter thereof to form a frustro-conical portion 34 having a steadily increasing inner diameter. Preferably, the frustro-conical portion 34 extends directly from the inner diameter 32 to the distal end 36. The tapering is accomplished by means commonly known in the art, i.e., flaring or tapering tools which have long been utilized for such purposes. Additionally, the distal end 36 is flared outward forming a flared extremity 38. The flared extremity 38 has an inner diameter which drastically increases; that is, the relative rate at which the inner diameter of the flared extremity 38 increases is greater than that at which the frustro-conical portion increases. The flared extremity 38 is formed using the same tools and techniques as employed in the tapering step discussed previously.

The end of the first tube 26 is necked to reduce the outer diameter thereof and form a necked end 38. The necking step employs techniques well known in the art. That is, common necking tools and techniques are utilized to accomplish the necking operation. Once necked, the necked end 38 has a reduced outer diameter 40 which is relatively uniform over the entire necked end 38. A transition region 42 is formed between the necked end 38 and the un-necked region of the first tube 26. The transition region 42 has a non-uniform outer diameter; that is, the outer diameter steadily increases from the necked end 38 to the un-necked region of the first tube 26.

Subsequent to the steps of necking, tapering and flaring, the ends of the tubes are cleansed in order to prepare the tubes for bonding. The cleansing step is common in the art and preferably involves dipping or spraying cleansing solvent on the tube ends. Such cleansing solvents are well known and are commercially available.

After cleansing, the residual cleaning solvent may be removed by allowing the tubes to air dry or, alternatively, by blowing air on the tubes to promote drying. Once clean and dry, the necked end 38 of the first tube 26 is inserted within the frustro-conical portion 34 of the second tube 30 until the necked end 38 is tightly interfit within the inner diameter 32 of the second tube 30 and the transition region 42 of the first tube 26 abuts the steadily increasing inner diameter of the frustro-conical portion 34 of the second tube 30 and forms a surface contact 50.

Liquid polymeric material is poured, spread, sprayed, or otherwise disposed through the frustro-conical portion access 52 and into the increasing gap space to form a solid bond 44 of steadily increasing thickness between the outer diameter 28 of the first tube 26 and the steadily increasing inner diameter of the frustro-conical portion 34 of the second tube (30). While air is permitted to escape therefrom. It is the frustro-conical shape of the end of the second tube 30 which allows air within the gap space to escape while the polymeric material is disposed into the gap space. Thus, air voids in the gap space are avoided. As previously described, the application of the adhesive material into the gap space is dependent upon the particular nature of the adhesive material, i.e., liquid adhesive may be poured whereas paste-like adhesives are typically spread into the gap space by way of a spatula or similar device.

The organic polymeric material is allowed to cure into a solid bond 44 of steadily increasing thickness between the outer diameter 28 of the first tube 26 and the steadily increasing inner diameter of the second tube 30 and extends from the surface contact 50 to a position adjacent the distal end 36. Preferably, the curing step involves heating the joint 24 in a conventional heat oven. The actual temperature and heat times of the heat exposure are typically dependent upon the specific polymer material being used and the actual thickness of the bond being formed.

Preferably, the organic polymeric material comprises an epoxy adhesive, such as B. F. Goodrich's A-1223-B epoxy resin. If such an epoxy resin is used, heat temperatures and times for curing are quite flexible; for example, 60 minutes at 350° F., 30 minutes at 375° F. or 15 minutes at 400° F.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed:

1. A joint for joining coolant tubes of a heat exchanger, said joint comprising:

a first tube (26) having an outer diameter (28);

a second tube (30) having an inner diameter (32), a frustro-conical portion (34), and a flared extremity (38);

said frustro-conical portion (34) tapering steadily outward from said inner diameter (32) to said flared extremity (38) and forming a steadily increasing inner diameter extending from said inner diameter (32) to said flared extremity (38);

said flared extremity (38) flaring steadily outward from said frustro-conical portion (34) and defining a frustro-conical access (52);

a first portion (46) of said first tube (26) disposed within said second tube (30) and forming a surface contact (50) between said outer diameter (28) of said first tube (26) and said steadily increasing inner diameter of said frustro-conical portion (34), and a second portion (48) of said first tube (26) extending out from said second tube (30);

a steadily increasing gap space formed between said outer diameter (28) of said first tube (26) and said steadily increasing inner diameter of said frustro-conical portion (34) of said second tube (30);

said gap space extending directly from said surface contact (50) and steadily increasing in thickness to a position adjacent said flared extremity (38), said a frustro-conical access (52) extending from said flared extremity (38) directly to said surface contact (50);

organic polymeric material disposed through said frustro-conical access (52) and into said increasing gap space to form a bond (44) of steadily increasing thickness between said outer diameter (28) of said first tube (26) and said steadily increasing inner diameter of said frustro-conical portion (34) of said second tube (30); and said bond (44) extending from said surface contact (50) between said increasing inner diameter of said frustro-conical portion (34) of said second tube (30) and said outer diameter (28) of said first tube (26) and steadily increasing in thickness to a position adjacent said flared extremity (38) thereby ensuring the formation of a bond of optimum thickness between the first (26) and second (30) tubes.

2. The joint as set forth in claim 1 wherein said first tube (26) includes a necked end (38) having a reduced outer diameter (40) and a transition region (42) having a steadily decreasing outer diameter interconnecting said outer diameter (28) and said necked end (38), and further characterized by, said necked end (38) of said first tube (26) tightly interfit within said inner diameter (32) of said second tube (30) and said transition region (42) of said first tube (26) in abutting contact with said frustro-conical portion (34) of said second tube (30) at said surface contact (50).

3. The joint as set forth in claim 2 further characterized by said bond (44) steadily increasing in thickness from said contact surface (50) to a thickness of at least 0.0065 inches.

4. The joint as set forth in claim 3 further characterized by said bond (44) steadily increasing in thickness from said contact surface (50) to a thickness of at least 0.00150 inches.

5. The joint as set forth in claim 4 further characterized by said organic polymeric material comprising epoxy resin.

6. A method for joining coolant tubes of a heat exchanger, said method comprising the steps of:

providing a first tube (26) having an outer diameter (28);

providing a second tube (30) having an inner diameter (32) and a distal end (36); and characterized by the steps of:

flaring the distal end (36) of the second tube (30) to form a flared extremity (38) which flares outward from the inner diameter (32);

tapering a portion of the second tube (30) to form a frustro-conical portion (34) having a steadily increasing inner diameter extending directly from the inner diameter (32) to the flared extremity (38);

necking an end of a first tube (26) to reduce an outer diameter (40) thereof and form a necked end (38) and a transition region (42) having a steadily decreasing outer diameter between the first tube (26) and the necked end (38);

inserting the necked end (38) of the first tube (26) within the inner diameter (32) of the second tube (30) until the transition region (42) of the first tube (26) forms a surface contact (50) with the steadily increasing inner diameter of the frustro-conical portion (34)

and forming a steadily increasing gap space extending directly from the surface contact (50) to a position adjacent said flared extremity (38); and disposing organic polymer material within the increasing gap space to form a bond (44) of steadily increasing thickness extending directly from the surface contact (50) between the first (26) and second (30) tubes to a position adjacent the flared extremity (38).

7. The joint as set forth in claim 6 further characterized by the step of heating the joint (24) to assist curing of the organic polymeric material.

8. The joint as set forth in claim 7 further characterized by the organic polymeric material comprising epoxy resin.

9. The method as set forth in claim 8 further characterized by the bond (44) having a thickness of at least 0.0065 inches.

10. The method as set forth in claim 8 further characterized by the bond (44) having a thickness of at least 0.0150 inches.

11. The method as set forth in claim 6 wherein the step of disposing the organic polymeric material within the gap space is further characterized by the step of spreading the organic polymeric material into the gap space.

12. The method as set forth in claim 6 wherein the step of disposing the organic polymeric material within the gap space is further characterized by the step of pouring the organic polymeric material into the gap space.

* * * * *